US009194394B2

(12) United States Patent
Yamada et al.

(10) Patent No.: US 9,194,394 B2
(45) Date of Patent: Nov. 24, 2015

(54) MOTOR-DRIVEN COMPRESSOR AND METHOD FOR MANUFACTURING THE SAME

(71) Applicant: KABUSHIKI KAISHA TOYOTA JIDOSHOKKI, Kariya-shi, Aichi-ken (JP)

(72) Inventors: Tetsuya Yamada, Aichi-ken (JP); Tatsuya Ito, Aichi-ken (JP); Ken Suitou, Aichi-ken (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 300 days.

(21) Appl. No.: 13/742,568

(22) Filed: Jan. 16, 2013

(65) Prior Publication Data

US 2013/0189091 A1 Jul. 25, 2013

(30) Foreign Application Priority Data

Jan. 20, 2012 (JP) ..... 2012-010350

(51) Int. Cl.

| | |
|---|---|
| ***F01C 1/063*** | (2006.01) |
| ***F04C 29/00*** | (2006.01) |
| ***F04C 23/02*** | (2006.01) |
| *F04C 18/02* | (2006.01) |

(52) U.S. Cl.

CPC ..... *F04C 29/0085* (2013.01); *F04C 23/02* (2013.01); *F04C 18/0215* (2013.01); *F04C 2230/60* (2013.01); *F04C 2240/30* (2013.01); *F04C 2240/40* (2013.01); *F04C 2240/603* (2013.01); *F04C 2240/803* (2013.01)

(58) Field of Classification Search

CPC ..... F04C 2240/30; F04C 2240/40; F04C 2240/803; F04C 18/0215

USPC ..... 417/410.1; 310/71

See application file for complete search history.

(56) References Cited

U.S. PATENT DOCUMENTS

| | | | | |
|---|---|---|---|---|
| 3,518,616 | A * | 6/1970 | Lewis | 439/470 |
| 5,762,526 | A | 6/1998 | Kuramoto et al. | |
| 8,152,490 | B2 | 4/2012 | Iguchi et al. | |

(Continued)

FOREIGN PATENT DOCUMENTS

| | | | |
|---|---|---|---|
| CN | 1139834 | A | 1/1997 |
| CN | 101463814 | A | 6/2009 |
| CN | 101666303 | A | 3/2010 |
| CN | 101809286 | A | 8/2010 |
| CN | 102011729 | A | 4/2011 |

(Continued)

OTHER PUBLICATIONS

Communication dated Aug. 24, 2015 from the State Intellectual Property Office of the People's Republic of China in counterpart application No. 201310020247.5.

*Primary Examiner* — Charles Freay

(74) *Attorney, Agent, or Firm* — Sughrue Mion, PLLC

(57) ABSTRACT

A motor-driven compressor includes an electric motor having a stator core, a compression mechanism driven by the electric motor, a motor housing accommodating the electric motor, and a cluster block engaged with the stator core in the motor housing. The stator core of the electric motor and the motor housing are assembled by shrink fit. The cluster block accommodates a connecting terminal for electrical connection between a conductor connected to a motor drive circuit and a lead wire drawn from the electric motor. The cluster block has a terminal hole for receiving the connecting terminal and has an opening that is provided separately from the terminal hole.

5 Claims, 4 Drawing Sheets

(56) References Cited

U.S. PATENT DOCUMENTS

| | | | |
|---|---|---|---|
| 8,303,271 | B2 | 11/2012 | Ikeda et al. |
| 8,323,005 | B2 | 12/2012 | Yamada et al. |
| 8,757,989 | B2 | 6/2014 | Murakami |
| 2005/0111994 | A1 | 5/2005 | Kimura et al. |

FOREIGN PATENT DOCUMENTS

| | | | |
|---|---|---|---|
| JP | 60-261339 | A | 12/1985 |
| JP | 5256261 | A | 10/1993 |
| JP | 8-312532 | A | 11/1996 |
| JP | 2006-042409 | A | 2/2006 |

* cited by examiner

MOTOR-DRIVEN COMPRESSOR AND METHOD FOR MANUFACTURING THE SAME

BACKGROUND OF THE INVENTION

The present invention relates to a motor-driven compressor and a method for manufacturing the same.

In a conventional motor-driven compressor, a compression mechanism for compression and discharge of refrigerant gas and an electric motor for driving the compression mechanism are provided in a housing of the compressor. The electric motor is provided in a motor housing that forms a part of the housing. A conductor connected to a motor drive circuit and a lead wire drawn from the electric motor are electrically connected through a connecting terminal in a cluster block that is provided in the motor housing. Japanese Unexamined Patent Application Publication No. 2006-42409 discloses a motor-driven compressor in which such cluster block is mounted to a stator core of the electric motor.

In the compressor disclosed in the publication No. 2006-42409, a projection with a dovetail cross section is formed in the cluster block, and a groove with a dovetail cross section is formed in the outer peripheral surface of the stator core mounted to the inner peripheral surface of the motor housing and extends along the axial direction of the stator core. The projection of the cluster block is slidingly inserted in the groove of the stator core so that the cluster block is mounted to the stator core. The cluster block is connected to a conductor extending through the motor housing.

The stator core with the cluster block and the motor housing are assembled together by shrink fit. In the assembling by shrink fit process, firstly, the motor housing is radially expanded by heating so that the inner diameter of the housing becomes larger than the outer diameter of the stator core, and the stator core with the cluster block is inserted into a suitable position in such heated and expanded motor housing. As the motor housing is cooled, the motor housing is shrunk radially inward and the inner peripheral surface of the motor housing is pressed against the outer peripheral surface of the stator core, so that the stator core is tightly fitted in the motor housing.

In the structure as disclosed in the publication No. 2006-42409, the engagement structure between the cluster block and the stator core allows a little adjustment of the position or orientation of the cluster block, which makes it easy to connect between the cluster block and the conductor. However, when the stator core is inserted into the heated motor housing, the cluster block may be moved and inclined relative to the stator core and then brought into contact with the heated motor housing. This may lead to thermal deformation of the cluster block, which may prevent proper connection between the cluster block and the conductor.

The present invention is directed to providing a motor-driven compressor and a method for manufacturing the same, which prevent the cluster block engaged with the stator core from being moved and inclined into contact with the motor housing when the stator core and the motor housing are assembled by shrink fit.

SUMMARY OF THE INVENTION

In accordance with an aspect of the present invention, a motor-driven compressor includes an electric motor having a stator core, a compression mechanism driven by the electric motor, a motor housing accommodating the electric motor, and a cluster block engaged with the stator core in the motor housing. The stator core of the electric motor and the motor housing are assembled by shrink fit. The cluster block accommodates a connecting terminal for electrical connection between a conductor connected to a motor drive circuit and a lead wire drawn from the electric motor. The cluster block has a terminal hole for receiving the connecting terminal and has an opening that is provided separately from the terminal hole.

Other aspects and advantages of the invention will become apparent from the following description, taken in conjunction with the accompanying drawings, illustrating by way of example the principles of the invention.

DETAILED DESCRIPTION OF THE EMBODIMENTS

Figure 1A:
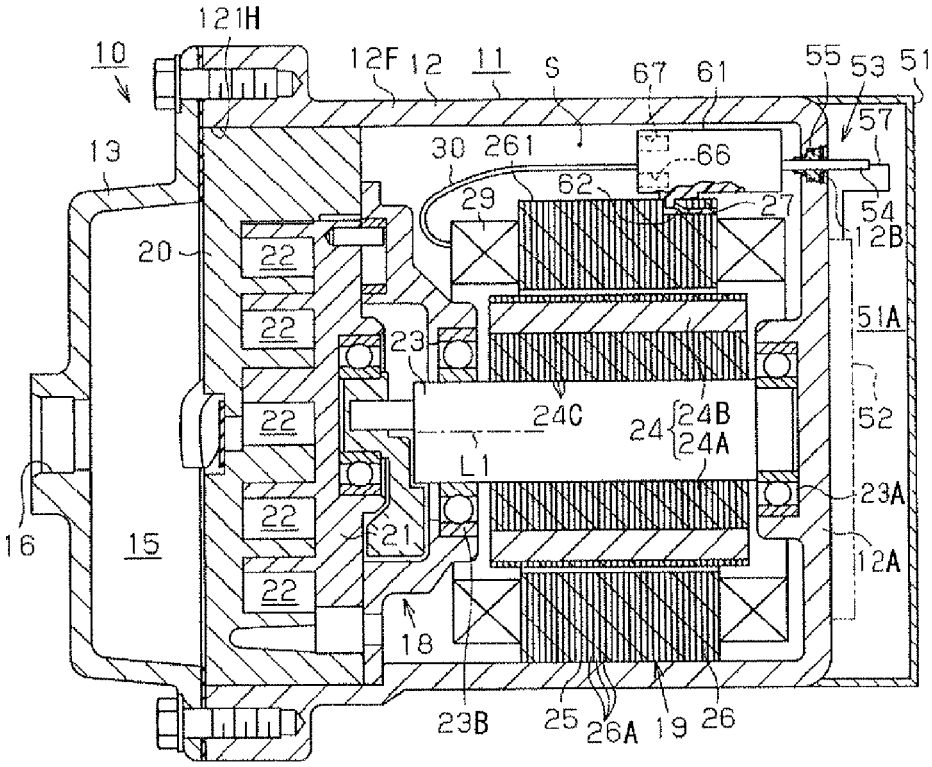
FIG. 1A is a longitudinal sectional view of a motor-driven compressor in accordance with an embodiment of the present invention.

The following will describe the embodiment of the motor-driven compressor in accordance with the present invention with reference to the accompanying drawings. Referring to FIG. 1A, the motor-driven compressor designated generally by 10 has a housing 11 made of a metal, for example an aluminum in the present embodiment. The housing 11 is formed by a cylindrical motor housing 12 having an opening 121H at one end on the left side in FIG. 1B and a cylindrical discharge housing 13 connected to the motor housing 12 to close the opening 121H. The motor housing 12 and the discharge housing 13 form therebetween a discharge chamber 15. An outlet port 16 is formed through the end wall of the discharge housing 13, through which the discharge chamber 15 is connected to an external refrigerant circuit (not shown) that is in turn connected to an inlet port (not shown either) formed through the peripheral wall of the motor housing 12. The motor housing 12 accommodates therein a compression mechanism 18 for compressing refrigerant gas and an electric motor 19 for driving the compression mechanism 18.

The motor housing 12 has an end wall 12A at the other end on the right side in FIG. 1A. The electric motor 19 is disposed in the motor housing 12 on the side of the compression mechanism 18 opposite from the discharge housing 13 and adjacent to the end wall 12A of the motor housing 12. The electric motor 19 has a stator 25 having a ring-shaped stator core 26 mounted on the inner peripheral surface of the motor housing 12 and a coil 29 wound on the teeth (not shown) of the stator core 26. The stator core 26 is formed of a plurality of laminating electromagnetic steel plates 26A.

Figure 1B:
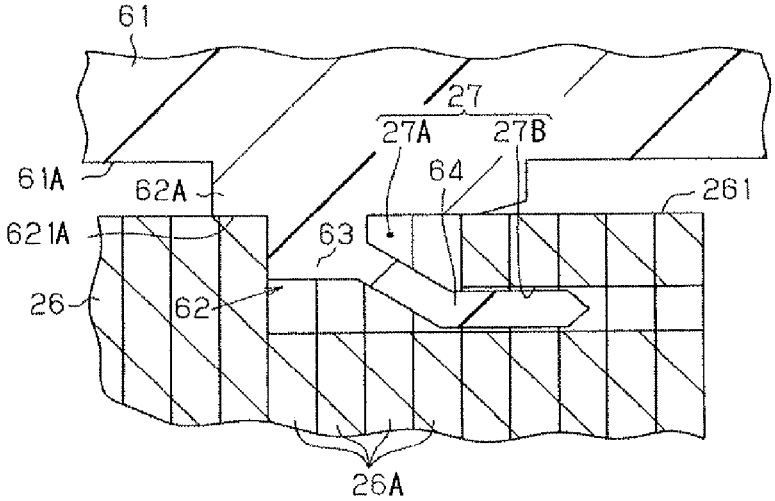
FIG. 1B is an enlarged fragmentary view of the compressor of FIG. 1, particularly showing a manner of engagement of a cluster block with a stator core of an electric motor of the compressor.

As shown in detail in FIG. 1B, the stator core 26 has an engagement hole 27 formed in its outer peripheral surface 261. The engagement hole 27 includes a recess 27A formed by partially cutting away the outer peripheral surfaces of a few plates 26A of the stator core 26 and a hole 27B extending continuously from the recess 27A through a few plates 26A of the stator core 26.

Referring back to FIG. 1A, a rotary shaft 23 is rotatably supported in the motor housing 12 by a pair of radial bearings 23A, 23B. A rotor 24 of the electric motor 19 is fixedly mounted on the rotary shaft 23 for rotation therewith. The rotor 24 includes a cylindrical rotor core 24A fixed on the rotary shaft 23 and plural permanent magnets 24B arranged spaced at a uniform angular interval and embedded in the rotor core 24A. The rotor core 24A is formed of plural laminated electromagnetic steel plates 24C. In the electric motor 19, lead wires 30 for U-phase, V-phase and W-phase (only one being shown in FIG. 1A) are drawn from the coil end of the coil 29 facing the compression mechanism 18.

The compression mechanism 18 has a fixed scroll 20 mounted in the motor housing 12 and a movable scroll 21 disposed in facing relation to the fixed scroll 20 and engaged therewith so as to form therebetween a compression chamber 22 the volume of which is variable.

A metal inverter cover 51 made of a metal, for example an aluminum in the present embodiment, is mounted to the end wall 12A of the motor housing 12 to form therebetween a space 51A in which a motor drive circuit 52 is mounted to the end wall 12A. In the present embodiment, the compression mechanism 18, the electric motor 19 and the motor drive circuit 52 are arranged in this order in the axial direction of the rotary shaft 23.

A hermetic terminal 53 including three metal terminals 54 or conductors and their associated three glass insulators 55 (each only one being shown in FIG. 1A) is disposed in a mounting hole 12B formed through the end wall 12A of the motor housing 12. Each metal terminal 54 extends through the motor housing 12 for electrical connection between the electric motor 19 and the motor drive circuit 52. The metal terminal 54 is insulated from the end wall 12A and supported by the insulator 55. One end of the metal terminal 54 is electrically connected to the motor drive circuit 52 through a cable 57, while the other end of the metal terminal 54 extends into the motor housing 12.

Figure 2:
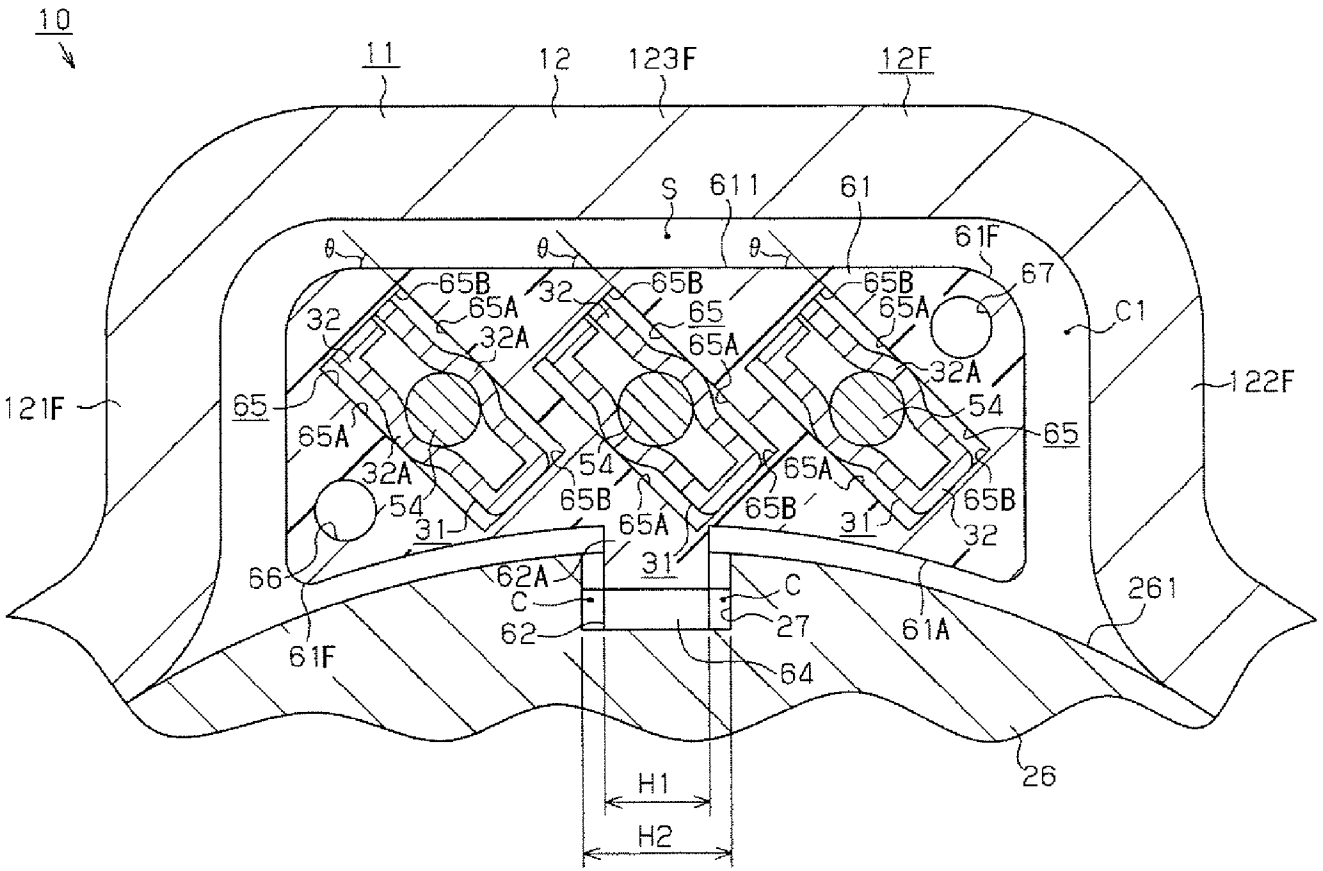
FIG. 2 is an enlarged cross-sectional view of the cluster block and its related components.

As shown in FIG. 2, part of the motor housing 12 projects radially outward to form a radially expanded portion 12F that extends in the axial direction of the rotary shaft 23 from the opening 121H to the end wall 12A of the motor housing 12. The expanded portion 12F includes a pair of first walls 121F, 122F extending in radial direction of the stator core 26 and a second wall 123F connecting the ends of the first walls 121F, 122F. The inner surfaces of the first and second walls 121F, 122F and 123F and the outer peripheral surface 261 of the stator core 26 cooperate to define a space S in which a cluster block 61 is disposed spaced from the inner surfaces of the first and second walls 121F, 122F and 123F by a gap C1.

The cluster block 61 has a generally box shape with an arcuate bottom surface 61A facing and curved along the outer peripheral surface 261 of the stator core 26. The cluster block 61 has a base 62A integrally formed therewith in the middle of the arch of the bottom surface 61A of the cluster block 61. As shown in detail in FIG. 1B, the cluster block 61 further has an engagement projection 62 formed integrally with the lower surface 621A of the base 62A and engagable with the engagement hole 27 of the stator core 26. The engagement projection 62 includes a square stop 63 projecting from the lower surface 621A of the base 62A and a bent portion 64 extending continuously from the stop 63.

Positioning the bent portion 64 and the stop 63 in the hole 27B and the recess 27A, respectively, the engagement projection 62 is engaged with the engagement hole 27, so that the cluster block 61 is engaged with the stator core 26 while being restricted from moving relative to the stator core 26 in the axial direction of the stator core 26 along the central axis L1 of the stator core 26.

As shown in FIG. 2, there exists a clearance C between the engagement projection 62 and the engagement hole 27 along the circumference of the stator core 26 because the width H1 of the engagement projection 62 as measured along the circumference of the stator core 26 is smaller than the width H2 of the engagement hole 27 as measured in the same manner. Therefore, the cluster block 61 is movable circumferentially relative to the stator core 26 within the clearance C, which allows the adjustment of the position or orientation of the cluster block 61 in connecting the metal terminal 54 of the hermetic terminal 53 to the cluster block 61 and hence makes it easy to assemble the compressor 10.

Figure 3A:
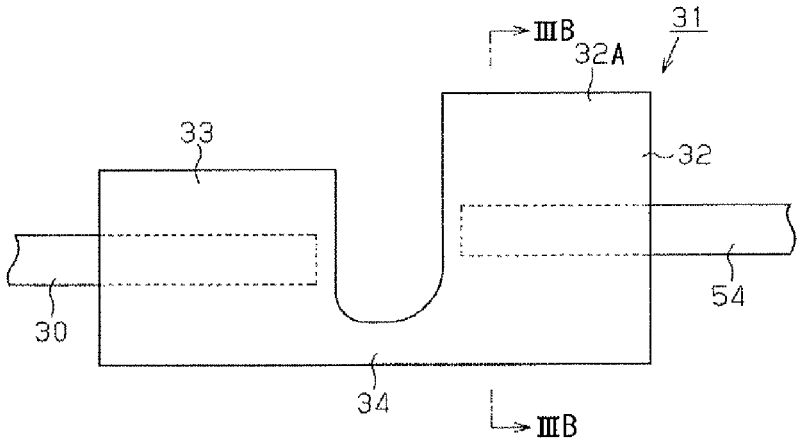
FIG. 3A is a schematic view of a connecting terminal to which a metal terminal and a lead wire are connected.
Figure 3B:
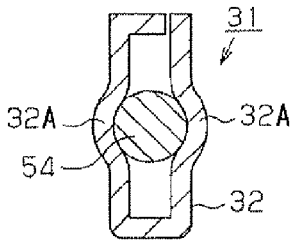
FIG. 3B is a cross-sectional view taken along the line IIIB-IIIB of FIG. 3A.

Three connecting terminals 31 to be connected to the metal terminals 54 of the hermetic terminal 53 are accommodated in the cluster block 61. As shown in FIGS. 3A and 3B, each connecting terminal 31 has at one end thereof a holder 32 of a generally rectangular cross section having opposite long sides 32A between which the metal terminal 54 is held for electrical connection between the metal terminal 54 and the connecting terminal 31. The connecting terminal 31 has at the other end thereof a clamp 33 by which the end of the lead wire 30 is clamped for electrical connection between the lead wire 30 and the connecting terminal 31. The holder 32 and the clamp 33 are connected by an connecting portion 34 of the connecting terminal 31.

As shown in FIG. 2, the cluster block 61 has three terminal holes 65 for receiving the respective connecting terminals 31. Each terminal hole 65 is of a rectangular cross section having a pair of long sides 65A extending along the long sides 32A of the holder 32 of the connecting terminal 31 and a pair of short sides 65B connecting the long sides 65A. Each terminal hole 65 is oriented so that the long side 65A is inclined at a predetermined angle θ relative to the upper surface 611 of the cluster block 61 that faces the second wall 123F of the expanded portion 12F of the motor housing 12.

The cluster block 61 has a recess 66 or an opening formed in a generally triangular region that is defined between the long side 65A of the terminal hole 65 on the left side in FIG. 2 and its opposite corner 61F adjacent to the bottom surface 61A. The cluster block 61 also has a recess 67 or an opening formed in a generally triangular region that is defined between the long side 65A of the terminal hole 65 on the right side in FIG. 2 and its opposite corner 61F adjacent to the upper surface 611. In other words, the recess 66 is formed at a position between the long side 65A of the terminal hole 65 on the left side in FIG. 2 and its opposite and adjacent corner 61F of the cluster block 61 and the recess 67 is formed at a position between the long side 65A of the terminal hole 65 on the right side in FIG. 2 and its opposite and adjacent corner 61F of the cluster block 61. Each of the recesses 66, 67 is of a round cross section and has an opening facing in the direction that is parallel to the central axis L1 of the stator core 26. The recesses 66, 67 are provided separately from the terminal holes 65.

Figure 4:
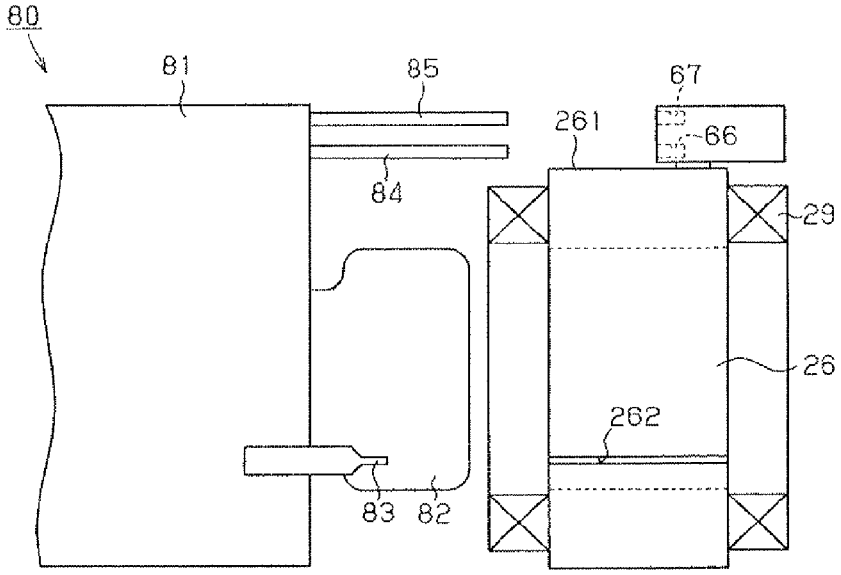
FIG. 4 is a schematic side view of an assembly jig that is used for assembling the stator core and the motor housing by shrink fit.
Figure 5:
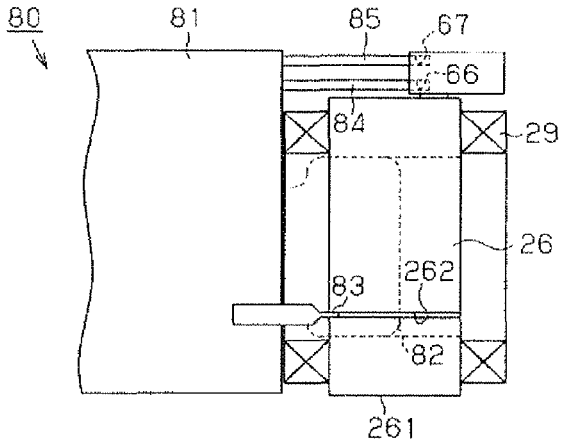
FIG. 5 is a schematic side view showing the assembly jig that is set to the stator core and the cluster block.

FIG. 4 shows an assembly jig 80 that is used for assembling the stator core 26 and the motor housing 12 by shrink fit. The assembly jig 80 has a base 81, a first portion 82 projecting from one end of the base 81, and a second portion 83. When assembling the stator core 26 in the motor housing 12, the first portion 82 is fitted inside the stator core 26 and the second portion 83 is fitted in a groove 262 formed in the outer peripheral surface 261 of the stator core 26 and extending straight along the central axis L1 of the stator core 26, as shown in FIG. 5. The assembly jig 80 further has projections 84, 85 which are to be fitted into the recesses 66, 67 of the cluster block 61 when assembling the stator core 26 in the motor housing 12. The projections 84, 85 are in the form of a stick having a round cross section and extending straight from the base 81.

The projections 84, 85 of the assembly jig 80 extend from the end of the base 81 in parallel relation to the central axis L1 of the stator core 26 and are located radially outward of the outer peripheral surface 261 of the stator core 26 when the first portion 82 is fitted inside the stator core 26 and the second portion 83 is fitted in the groove 262 of the stator core 26. The projections 84, 85 projecting from the end of the base 81 have a length that is large enough for the projections 84, 85 to be fitted in the respective recesses 66, 67 of the cluster block 61 when the first portion 82 is fitted inside the stator core 26 and the second portion 83 is fitted in the groove 262 of the stator core 26.

The following will describe the process of manufacturing the compressor 10 of the present embodiment. Firstly, as shown in FIG. 5, the assembly jig 80 is set to the stator core 26 in such a manner that the first portion 82 is fitted inside the stator core 26 and the second portion 83 is fitted into the groove 262 of the stator core 26. Simultaneously, the projections 84, 85 of the assembly jig 80 are fitted into the respective recesses 66, 67 of the cluster block 61. Thus the assembly jig 80 restricts the cluster block 61 from moving relative to the stator core 26 along the circumference of the stator core 26.

Figure 6:
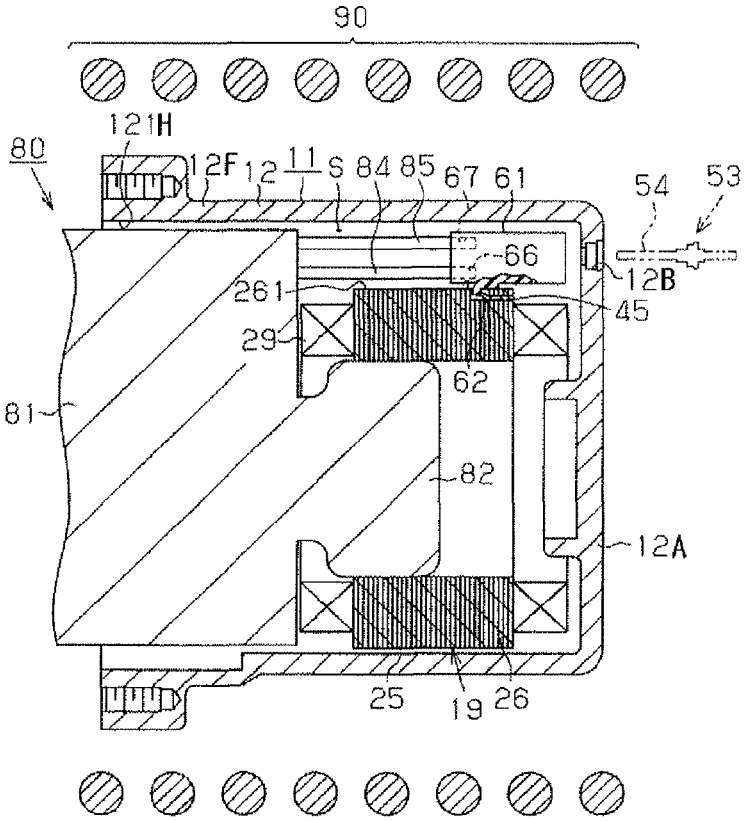
FIG. 6 is a schematic sectional view showing the state where the stator core with the cluster block is inserted into the heated and expanded motor housing.

Then, as shown in FIG. 6, heating the motor housing 12 in a coil 90 by induction heating, the whole of the motor housing 12 is radially expanded and the inner diameter of the motor housing 12 becomes larger than that before heating. The stator core 26 is inserted with the cluster block 61 into the expanded motor housing 12 through its opening 121H in such a way that the cluster block 61 is moved into the space S.

With the stator core 26 positioned in place in the motor housing 12 and the cluster block 61 positioned in place in the space S in the motor housing 12, the motor housing 12 is cooled. Accordingly, the motor housing 12 is shrunk radially inward so that the inner peripheral surface of the motor housing 12 is pressed against the outer peripheral surface 261 of the stator core 26, so that the stator core 26 is tightly fitted in the motor housing 12.

Mounting the hermetic terminal 53 in the mounting hole 12B after the stator core 26 with the cluster block 61 is assembled in the motor housing 12, the metal terminal 54 of the hermetic terminal 53 is connected to the connecting terminal 31 in the cluster block 61. That is, when the stator core 26 and the motor housing 12 are assembled by shrink fit, the stator core 26 is positioned in place in the motor housing 12 and the cluster block 61 is positioned in place in the space S in the motor housing 12 so that the metal terminal 54 of the hermetic terminal 53 is connected to the connecting terminal 31 in the cluster block 61 simultaneously with the mounting of the hermetic terminal 53 in the mounting hole 12B. It is noted that, in FIGS. 4 through 6, the illustration of the lead wire 30 previously connected to the connecting terminal 31 is omitted for simplicity.

In the above-described compressor 10, while electric power is supplied to the electric motor 19 under the control of the motor drive circuit 52, the rotary shaft 23 is rotated with the rotor 24 of the electric motor 19 at a controlled speed to drive the compression mechanism 18. Refrigerant gas introduced from the external refrigerant circuit through the inlet port into the motor housing 12 is compressed by the compression mechanism 18 and then discharged through the outlet port 16 back into the external refrigerant circuit.

Positioning of the cluster block 61 relative to the assembly jig 80 is accomplished by fitting the projections 84, 85 of the assembly jig 80 into the recesses 66, 67 of the cluster block 61 when the stator core 26 is inserted into the motor housing 12 expanded by heating. The assembly jig 80 restricts the cluster block 61 from moving relative to the stator core 26 along the circumference of the stator core 26, which prevents the cluster block 61 from coming into contact with the heated motor housing 12 and hence prevents thermal deformation of the cluster block 61 due to the contact of the cluster block 61 with the heated motor housing 12 when the stator core 26 and the motor housing 12 are assembled by shrink fit.

The compressor 10 according to the first embodiment offers the following advantages.

(1) When the stator core 26 is inserted into the heated motor housing 12, the assembly jig 80 having the projections 84, 85 that are to be fitted into the recesses 66, 67 of the cluster block 61 is used. By fitting the projections 84, 85 of the assembly jig 80 into the associated recesses 66, 67 of the cluster block 61, the cluster block 61 is positioned properly relative to the assembly jig 80 and hence restricted from moving circumferentially relative to the stator core 26, which prevents the cluster block 61 engaged with the stator core 26 from moving and inclining into contact with the heated motor housing 12 when the stator core 26 and the motor housing 12 are assembled by shrink fit.

(2) The openings of the recesses 66, 67 faces in the direction that is parallel to the central axis L1 of the stator core 26. When the motor housing 12 and the stator core 26 are assembled by shrink fit, the projections 84, 85 of the assembly jig 80 can be easily inserted into the recesses 66, 67 of the cluster block 61 simultaneously with the setting of the assembly jig 80 to the stator core 26, which makes it easy to assemble the stator core 26 and the motor housing 12.

(3) The present embodiment in which the assembly jig 80 has two projections such as 84, 85 and the cluster block 61 has two recesses such as 66, 67 makes it easier to position the cluster block 61 relative to the assembly jig 80 and also prevents rotation of the cluster block 61 when such recesses are of a round cross section, as compared to the case that the assembly jig 80 has only one projection and the cluster block 61 has only one recess.

(4) Each of the terminal holes 65 formed in the cluster block 61 is oriented so that the opposite long sides 65A of the terminal hole 65 are inclined relative to the upper surface 611 of the cluster block 61, and each of the recesses 66, 67 is formed in the region that is defined between the long side 65A of the terminal hole 65 and its opposite and adjacent corner 61F in the rectangular cross section of the cluster block 61. This allows efficient arrangement of the terminal holes 65 and the recesses 66, 67 in the cluster block 61 and results in reduced size of the cluster block 61.

(5) In the compressor 10 of the present embodiment in which the compression mechanism 18, the electric motor 19 and the motor drive circuit 52 are arranged in this order in the axial direction of the rotary shaft 23 and the lead wire 30 is drawn out from the coil end facing the compression mechanism 18, there is no need to connect between the electric motor 19 and the motor drive circuit 52 in a narrow space therebetween, specifically the space between the end of the stator core 26 and the end wall 12A of the motor housing 12. In other words, such electrical connection between the electric motor 19 and the motor drive circuit 52 can be accomplished by simply connecting the metal terminal 54 of the hermetic terminal 53 to the connecting terminal 31 in the cluster block 61, resulting in efficient assembly of the compressor 10. In addition, mounting the hermetic terminal 53 in the mounting hole 12B with the cluster block 61 engaged with the stator core 26 in the motor housing 12, the metal terminal 54 of the hermetic terminal 53 is electrically connected to the connecting terminal 31 in the cluster block 61. The connection between the metal terminal 54 and the connecting terminal 31 can be accomplished simultaneously with the mounting of the hermetic terminal 53 in the mounting hole 12B. Furthermore, there is no need to mount the cluster block 61 to the outer peripheral surface 261 of the stator core 26 after the assembly of the stator core 26 and the motor housing 12, which makes it easy to assemble the compressor 10.

The above embodiment may be modified in various ways as exemplified below.

The engagement hole 27 and its associated engagement projection 62 may be of any suitable shape.

The cross sections of the recesses 66, 67 of the cluster block 61 may be of a triangular or square shape, and the cross sections of the projections 84, 85 of the assembly jig 80 may be of a triangular or square shape.

Each of the recesses 66, 67 of the cluster block 61 may be replaced by a hole extending through the cluster block 61.

The number of projections of the assembly jig 80 and the number of recesses of the cluster block 61 are not limited to two. The assembly jig 80 may have only one projection or three or more projections, and the cluster block 61 may have only one recess or three or more recesses. If the assembly jig 80 has only one projection and the cluster block 61 has only one recess, the cross sections of the projection and the recess should preferably be of a triangular or square shape because the fitting of such projection in the recess prevents the cluster block 61 from rotating relative to the stator core 26 about the axes of such recess and projection.

The assembly jig 80 may have a recess and the cluster block 61 may have a projection so that positioning of the cluster block 61 relative to the assembly jig 80 is accomplished by fitting between such projection and recess.

The number of terminal holes 65 and the number of their associated connecting terminals 31, metal terminals 54 and lead wires 30 are not limited.

The terminal hole of a rectangular cross section formed in the cluster block 61 may be oriented so that the opposite long sides extend perpendicular to the upper surface 611 of the cluster block 61. Alternatively, the terminal hole may be oriented so that the opposite long sides extend parallel to the upper surface 611 of the cluster block 61.

The position of the recess in the cluster block 61 is not limited as long as the recess is associated with the projection of the assembly jig 80.

The compression mechanism 18, the electric motor 19 and the motor drive circuit 52 do not necessarily need to be arranged in this order in the axial direction of the rotary shaft 23. For example, the inverter cover 51 may be mounted to the peripheral wall of the motor housing 12 to form therebetween a space in which the motor drive circuit 52 is disposed.

In the cluster block 61, the engagement projection 62 may be formed on the bottom surface 61A without the provision of the base 62A.

The engagement projection 62 may be formed separately from the cluster block 61.

Although in the previous embodiment the motor drive circuit 52 is mounted to the end wall 12A in the space 51A, the motor drive circuit 52 may be mounted to the inner surface of the inverter cover 51 in the space 51A.

Although the compression mechanism 18 in the previous embodiment is of a scroll type having the fixed and movable scrolls 20, 21, it may be of a piston type or a vane type.

What is claimed is:

1. A motor-driven compressor, comprising:

an electric motor having a stator core;

a compression mechanism driven by the electric motor;

a motor housing accommodating the electric motor, wherein the stator core of the electric motor and the motor housing are assembled by shrink fit; and a cluster block engaged with the stator core in the motor housing, the cluster block accommodating a connecting terminal for electrical connection between a conductor connected to a motor drive circuit and a lead wire drawn from the electric motor, wherein the cluster block has a terminal hole for receiving the connecting terminal and has an opening that is provided separately from the terminal hole, wherein the terminal hole is of a rectangular cross section having opposite long sides, wherein the terminal hole is oriented so that the long side is inclined, relative to an upper surface of the cluster block, and wherein the opening is formed at a position between the long side of the terminal hole and an opposing corner of the cluster block.

2. The motor-driven compressor of claim 1, wherein the opening of the cluster block faces in the direction that is parallel to the central axis of the stator core.

3. The motor-driven compressor of claim 1, wherein the cluster block has plural openings.

4. The motor-driven compressor of claim 1, wherein the compression mechanism, the electric motor and the motor drive circuit are arranged in this order in the axial direction of the rotary shaft.

5. A method for manufacturing a motor-driven compressor comprising: an electric motor having a stator core; a compression mechanism driven by the electric motor; a motor housing accommodating the electric motor, wherein the stator core of the electric motor and the motor housing are assembled by shrink fit; and a cluster block engaged with the stator core in the motor housing, the cluster block accommodating a connecting terminal for electrical connection between a conductor connected to a motor drive circuit and a lead wire drawn from the electric motor, wherein the cluster block has a terminal hole for receiving the connecting terminal and has an opening that is provided separately from the terminal hole, wherein the terminal hole is of a rectangular cross section having opposite long sides, wherein the terminal hole is oriented so that the long side is inclined, relative to an upper surface of the cluster block, and wherein the opening is formed at a position between the long side of the terminal hole and an opposing corner of the cluster block, the method comprising:

heating the motor housing so that the whole of the motor housing is radially expanded;

setting an assembly jig to the stator core in such a manner that part of the assembly jig is fitted into the opening of the cluster block;

inserting the stator core with the cluster block into the expanded motor housing; and cooling the motor housing so that the motor housing is shrunk radially inward and the inner peripheral surface of the motor housing is pressed against the outer peripheral surface of the stator core.

* * * * *